US008567320B2

(12) United States Patent
Tavares et al.

(10) Patent No.: US 8,567,320 B2
(45) Date of Patent: Oct. 29, 2013

(54) RESILIENT PAD FOR RAILROAD VEHICLE

(75) Inventors: Manuel Tavares, Doylestown, PA (US); Michael James Schmidt, Norristown, PA (US)

(73) Assignee: Pennsy Corporation, West Chester, PA (US)

( * ) Notice: Subject to any disclaimer, the term of this patent is extended or adjusted under 35 U.S.C. 154(b) by 0 days.

(21) Appl. No.: 12/931,069

(22) Filed: Jan. 24, 2011

(65) Prior Publication Data

US 2012/0186486 A1 Jul. 26, 2012

(51) Int. Cl.
*B61C 9/00* (2006.01)

(52) U.S. Cl.
USPC ..... 105/224.1; 105/223; 105/225

(58) Field of Classification Search
USPC ..... 105/218.1, 218.2, 219, 220, 222, 223, 105/224, 225
See application file for complete search history.

(56) References Cited

U.S. PATENT DOCUMENTS

| | | | | | |
|---|---|---|---|---|---|
| 1,964,671 | A | | 6/1934 | Nesbitt | |
| 2,648,573 | A | | 8/1953 | Wheildon | |
| 3,381,629 | A | * | 5/1968 | Jones | 105/218.1 |
| 3,638,582 | A | | 2/1972 | Beebe | |
| 3,699,897 | A | * | 10/1972 | Sherrick | 105/218.1 |
| 3,785,298 | A | * | 1/1974 | Reynolds | 105/218.1 |
| 3,897,736 | A | | 8/1975 | Tack | |
| 4,094,253 | A | | 6/1978 | Gage | |
| 4,108,080 | A | | 8/1978 | Garner et al. | |
| 4,168,666 | A | | 9/1979 | Gage | |
| 4,170,180 | A | | 10/1979 | Houston | |
| 4,203,371 | A | | 5/1980 | Tack | |
| 4,239,007 | A | | 12/1980 | Kleykamp et al. | |
| 4,313,384 | A | | 2/1982 | Holden et al. | |
| 4,363,278 | A | * | 12/1982 | Mulcahy | 105/218.1 |
| 4,380,199 | A | | 4/1983 | Thomson et al. | |
| 4,428,303 | A | * | 1/1984 | Tack | 105/225 |
| 4,785,740 | A | | 11/1988 | Grandy | |
| 5,009,521 | A | | 4/1991 | Wiebe | |
| 5,081,935 | A | * | 1/1992 | Pavlick | 105/224.1 |
| 5,237,933 | A | | 8/1993 | Bucksbee | |
| 5,404,826 | A | * | 4/1995 | Rudibaugh et al. | 105/222 |
| 5,425,312 | A | * | 6/1995 | Tack, Jr. | 105/225 |
| 5,562,045 | A | * | 10/1996 | Rudibaugh et al. | 105/224.1 |
| 5,799,582 | A | * | 9/1998 | Rudibaugh et al. | 105/222 |
| 6,178,894 | B1 | * | 1/2001 | Leingang | 105/224.1 |
| 6,234,083 | B1 | * | 5/2001 | Tack, Jr. | 105/225 |
| 6,347,588 | B1 | * | 2/2002 | Leingang | 105/224.1 |
| 6,823,741 | B2 | | 11/2004 | Gammon | |
| 6,895,866 | B2 | | 5/2005 | Forbes | |

(Continued)

*Primary Examiner* — Jason C Smith
(74) *Attorney, Agent, or Firm* — John F. A. Earley, III; Frank J. Bonini, Jr.; Harding, Earley, Follmer & Frailey, P.C.

(57) ABSTRACT

A resilient pad having a base with two side arms and two side lips for resiliently holding the base on a pedestal wear plate, the pad being configured with dome shaped portions disposed substantially perpendicular to the direction of the pad and being spaced apart from each other, where the pad, when installed with a pedestal wear plate serves to improve the force load handling and preferably re-distributes the load bearing surface from the edges and center of the adapter to the flat load bearing surface of the adapter, thus eliminating load on areas that have no support. Because the spring arms do not depend on bending of the base for their resiliency, the pad of the invention provides improved service stress capabilities and allows for longer life of the wear plate.

33 Claims, 7 Drawing Sheets

(56) References Cited

U.S. PATENT DOCUMENTS

| | | | | |
|---|---|---|---|---|
| 7,004,079 | B2 | 2/2006 | Forbes | |
| 7,143,700 | B2 * | 12/2006 | Forbes et al. | 105/223 |
| 7,174,837 | B2 | 2/2007 | Berg et al. | |
| 7,231,878 | B2 | 6/2007 | Wike | |
| 7,255,048 | B2 | 8/2007 | Forbes | |
| 7,263,931 | B2 | 9/2007 | Forbes | |
| 7,267,059 | B2 | 9/2007 | Forbes | |
| 7,308,855 | B2 * | 12/2007 | Van Auken | 105/218.1 |
| 7,328,659 | B2 | 2/2008 | Forbes | |
| 7,387,074 | B2 | 6/2008 | Myers | |
| 7,497,169 | B2 * | 3/2009 | Forbes et al. | 105/218.1 |
| 7,739,961 | B2 * | 6/2010 | East et al. | 105/218.1 |
| 7,845,288 | B2 * | 12/2010 | Forbes et al. | 105/223 |

* cited by examiner

RESILIENT PAD FOR RAILROAD VEHICLE

BACKGROUND OF THE INVENTION

1. Field of the Invention

This invention relates to a pad for handling force loads to prevent wear on the load bearing surface of a pedestal of a rail vehicle, and more particularly relates to improvements in force handling in an arrangement where a wear plate specifically designed for convenient and removable installation in the pedestal opening of a railway side frame is used in order to prevent wear on the load bearing surface of the pedestal.

2. Brief Description of the Related Art

For the sake of brevity, the teachings and complete disclosures of previous U.S. Pat. Nos. 3,897,736 and 4,203,371 are incorporated herein by reference. In many cases, a bearing adapter is provided over the axle bearing, said adapter having a slightly arcuate top surface which bears directly against a corresponding downwardly facing surface in the pedestal opening of the side frame. This arcuate top surface provides the wheel and axle with a freely pivoting end condition to avoid binding loads on the roller bearing. In order to reduce wear on the pedestal, a wear plate is placed between the downwardly facing pedestal surface and the top surface of the bearing adapter. The wear plate may have side lips and may clip onto the pedestal.

In service, movement or frictional sliding may occur between the bearing adapter and the clip-on pedestal wear plate, which may cause damage to the clip-on pedestal wear plate, resulting in the need to replace the wear plate. This condition also may result in the loss of the freely pivoting end condition and may weaken the frame at a load-bearing location. Repair of the frame surface is both expensive and time-consuming, since the worn surface must be ground down to return it to a flat condition. The amount of grinding allowed, however, is limited by structural considerations; after the limit has been reached, the side frame casting is condemned. Replacing the clip-on wear plate is less expensive, but still costly, as it involves removing the railroad car from service and jacking the car so that the broken clip-on wear plates can be removed and replaced.

The plate working load and stress are defined as the frictional forces applied to the wear plate by the bearing adapter as a rail car in service shifts and moves about laterally. These frictional forces induce a tendency for lateral movement of the wear plate, and are opposed by the corresponding friction developed between the plate top and the pedestal roof surface. If this opposing frictional force is insufficient to resist this movement, additional bending load and stress are imposed on the side lips of the wear plate. The sensitivity to imbalance in these frictional forces, and hence the tendency to impose stress and load on the plate side lips, increases with heavily loaded rail cars such as coal cars.

The result of the total installation related tensile stresses in combination with stress related to bearing adapter friction can result in a significant shortening of the plate service life. In some cases, the total tensile stresses developed may reach the yield strength of the plate and thereby cause bending of the plate. In other more severe cases the ultimate strength of the plate may be reached causing cracking of the plate.

The problem of the frictional force load handling has been further complicated as of late because of recent frame painting practices. As environmental concerns have caused an effort to reduce volatile organic emissions from sources including paints, rail car frames are increasingly being painted with solvent-free and alternative solvent based paints. One of the disadvantages of these paints is that a resultant painted surface will have a significantly lower coefficient of friction as compared to a surface painted by older "traditional" paints; at times the new paint may even be thought of as acting as a sort of lubricant. This has the disadvantageous result of greatly reducing the frictional force between the plate top surface and the pedestal roof surface, thereby increasing the effective tensile stress in the plate. This has in turn resulted in an increased occurrence in wear plate bending and cracking.

Increasing the thickness of the plate would seem to offer a means to achieving increased plate strength sufficient to resist lateral movement and consequent failure. The benefits of increasing plate thickness, however, are limited. A practical limit on plate thickness exists as installation bending stresses caused as the side lips are forced apart during plate installation increase in direct proportion to the plate thickness. The difference between these installation bending stresses and the ultimate stress at which failure occurs determine the working capacity of the plate to resist movement. At some thickness a maximum plate working capacity is reached and further thickness increases actually decrease working capacity.

For the above stated reasons, an unresolved need exists for a pedestal wear plate or wear plate assembly with an improved ability to withstand tensile stresses and thereby enjoy a reduced occurrence of bending and cracking.

SUMMARY OF THE INVENTION

According to a preferred embodiment, a resilient pad for use in connection with a pedestal wear plate is provided. The pad prevents or minimizes the aforesaid problems associated with plate tensile stress bending and cracking, while not introducing any significant increase in required installation effort. The pad is configured to facilitate handling of the load forces and stresses, and preferably accomplishes this by substantially absorbing and distributing the stresses while increasing the friction between the clip-on wear plate and the pedestal roof.

According to preferred embodiments, the pad has a configuration that facilitates the distribution of force loads and prevents or minimizes the concentration of force loads at a particular location.

According to a preferred embodiment, the pad comprises a face with a substantially flat surface that engages the pedestal wear plate and has a bulged opposite face. Retaining elements preferably are provided to facilitate holding of the pad on the wear plate. According to one embodiment, two lips at opposite ends of the pad running perpendicular to the pad's length, as well as two extensions on either side of the pad running parallel to the pad's length, hold the pad in a preferred location, centered on the clip-on wear plate.

According to a preferred embodiment, the force handling structures include two bulges, which preferably are dome-shaped, and act to distribute downward force loads and horizontally spread these loads out over the surface of the clip-on wear plate.

According to one embodiment, the force handling structures are provided on both sides of the pad. According to another embodiment, one side of the pad has a substantially flat surface and the other side of the pad has a surface that contains bulged regions.

It is an object of the invention to provide a pad that provides a more evenly distributed force load relative to the wear plate so as to avoid concentration of force loads in a particular location on the wear plate.

It is another object of the present invention to provide a pad that reduces or eliminates point loading associated with the poor surface finish of the cast pedestal roof, where the surface finishes are associated with lower coefficients of friction.

It is an object of the invention to extend the life of a resilient pedestal wear plate by changing the load bearing and friction characteristics to offer improved capacity to withstand tensile stresses, while not significantly increasing required installation effort.

According to an alternate embodiment, a pad is provided and is configured for disposition between a bearing adapter and a pedestal surface to facilitate the handling of force loads. The alternate embodiment preferably is constructed with one or more features to facilitate alignment of the pad with the bearing adapter surface. According to some embodiments, the pad may be installed between the bearing adapter and the pedestal roof surface (such as the flat surface in a pedestal opening), with the lower surface of the pad engaging the bearing adapter and the upper surface of the pad engaging the pedestal roof surface.

DETAILED DESCRIPTION OF THE PREFERRED EMBODIMENTS

Figure 1:
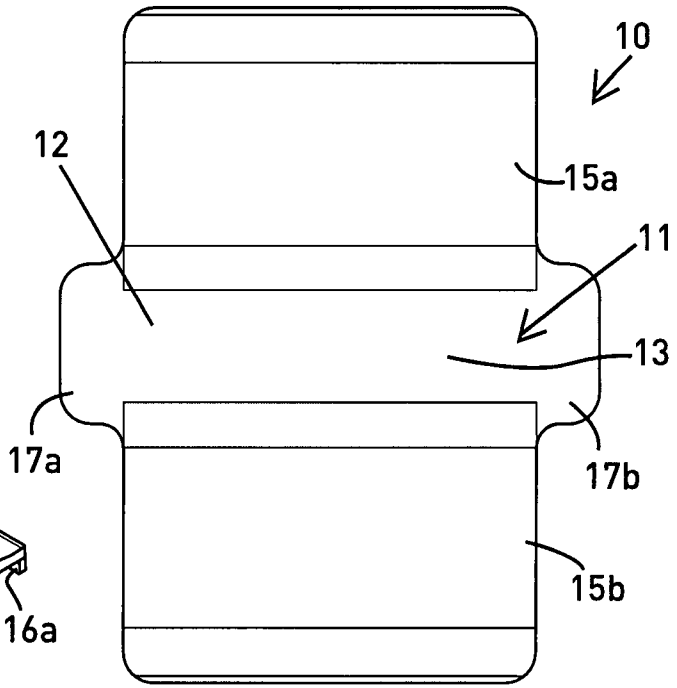
FIG. 1 is a top plan view of a first embodiment of a pad according to the invention.
Figure 2:
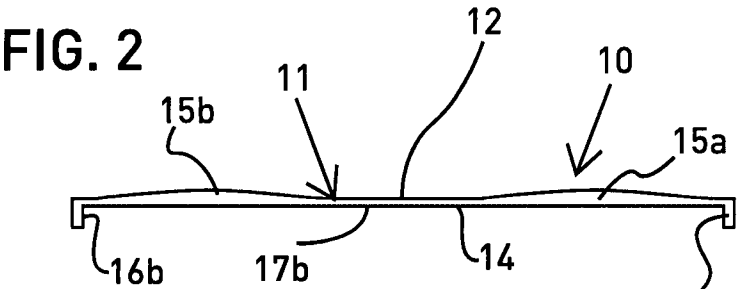
FIG. 2 is a right side elevation view of the pad of FIG. 1.
Figure 3:
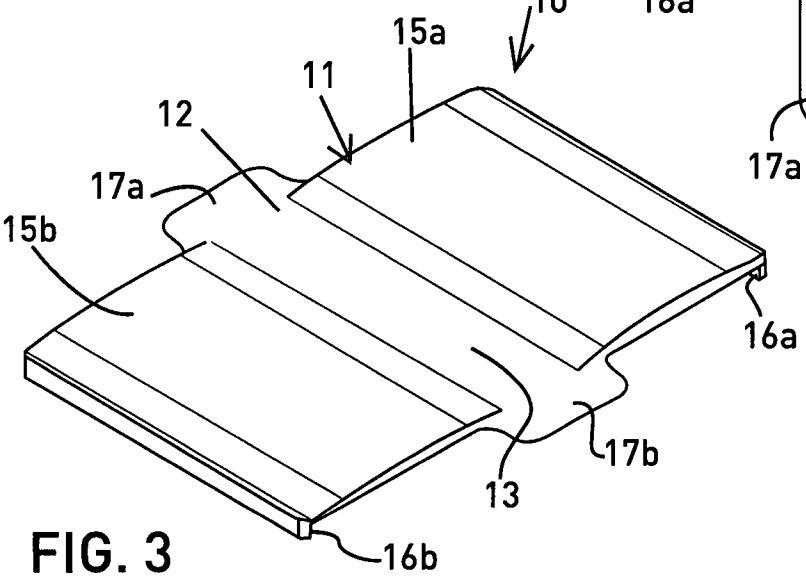
FIG. 3 is a perspective view of the pad of FIG. 1.

Referring to FIGS. 1-3, a preferred embodiment of a pad 10 for a wear plate is shown having a main body 11 with an upper surface 12 and lower surface 14. According to a preferred embodiment, the lower surface 14 is configured as a substantially planar surface. Preferably, the upper surface 12 is provided having force handling means comprising a force handling configuration. According to a preferred embodiment, the force handling means is illustrated comprising raised portions 15*a*, 15*b* of the surface 12. The raised portions 15*a*, 15*b* preferably are bulged and are disposed transversely on the pad 10 in a spaced apart relation to each other. As illustrated in FIGS. 1-3, the pad 10 has a spacing portion 13, with the raised portions 15*a*, 15*b* being provided on opposite sides of the spacing portion 13. The pad 10 preferably includes a feature for holding and aligning the pad 10 in an appropriate location for installation. Holding means for facilitating holding and aligning of the pad 10 is illustrated comprising the centering wings or extended portions 17*a*, 17*b* disposed protruding outwardly from the pad 10 on opposite lateral sides thereof. In addition, the holding means preferably includes holding elements, such as, for example, the lips 16*a*, 16*b*, which are shown transversely disposed on each'end of the pad 10. The lips 16*a*, 16*b* are provided at each pad end and run perpendicular to the pad's length at opposite ends of the pad. The extended portions 17*a*, 17*b*, preferably are disposed on each lateral side of the pad 10, parallel to the pad's length, to hold the pad in a centered position when installed on a clip-on wear plate. Preferably, the pad 10 is constructed having dimensions that conform to the wear plate in which the pad 10 is to be installed. The lips 16*a*, 16*b* preferably, are disposed at each end of the pad 10 so that the lips 16*a*, 16*b* may engage an edge of a wear plate when installed. This facilitates aligning the pad 10 relative to a wear plate, as well as maintaining the pad 10 in an aligned position during installation of other components, or, for example, when lowering a jacked truck back to its original position. Although illustrated as a continuous portion, the lips 16*a*, 16*b* may be provided as one or more segmented portions, including, for example, a pair of segments on each opposite edge of the pad 10.

Preferably, the raised portions 15*a*, 15*b* are configured as two dome shaped bulges which, when encountering the force from the frame 510 or pedestal 511 (see FIGS. 9-11) act to distribute the downward force, and, preferably, to evenly spread the force out on the surface of the clip-on wear plate 525. The pad 10 also eliminates or minimizes the point loading associated with the poor surface finishes that may be present on the cast pedestal roof.

Figure 4:
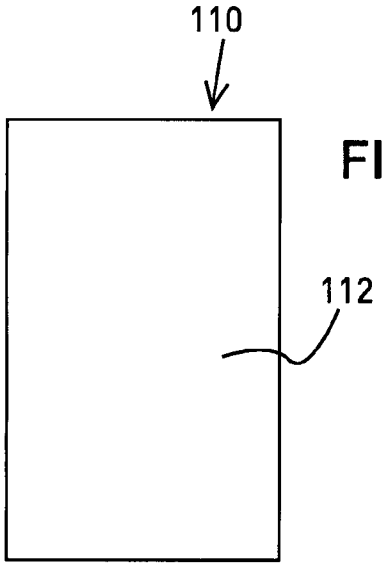
FIG. 4 is a top plan view of a second embodiment of a pad according to the invention.
Figure 5:
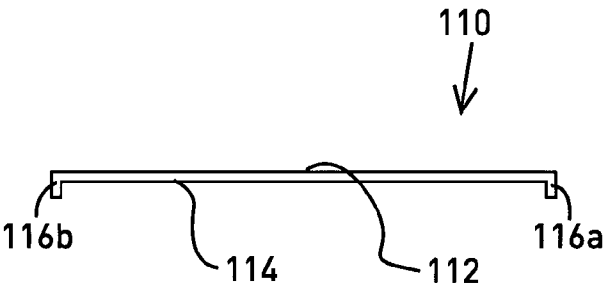
FIG. 5 is a right side elevation view of the second embodiment of the pad shown in FIG. 4.
Figure 6:
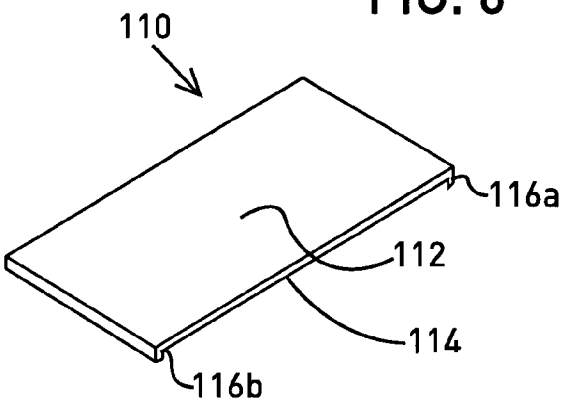
FIG. 6 is a perspective view of the pad of FIG. 4.

FIGS. 4-6 illustrate a pad 110 constructed according to a second preferred embodiment of the invention. Referring to the side elevation view of FIG. 5, the pad 110 preferably has a substantially flat base 114 and top surface 112 to provide for a more uniform and integral fit to the clip-on wear plate and roof liner. In this embodiment, the pad 110 is constructed to be substantially as wide as the clip-on wear plate, and the extended portions 17*a*, 17*b* on the pad 10 of FIGS. 1-3, are not provided. The second embodiment of the pad 110 is also shown with locking lips 116*a*, 116*b* running perpendicular to the length of the pad 110 and being transversely disposed at each end of the pad 110.

Figure 7:
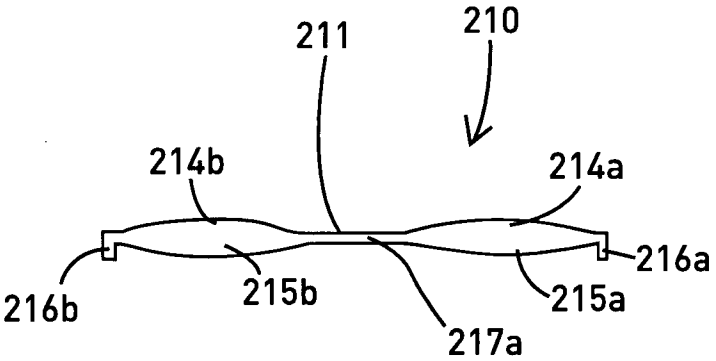
FIG. 7 is a right side elevation view of a third embodiment of a pad according to the invention.
Figure 8:
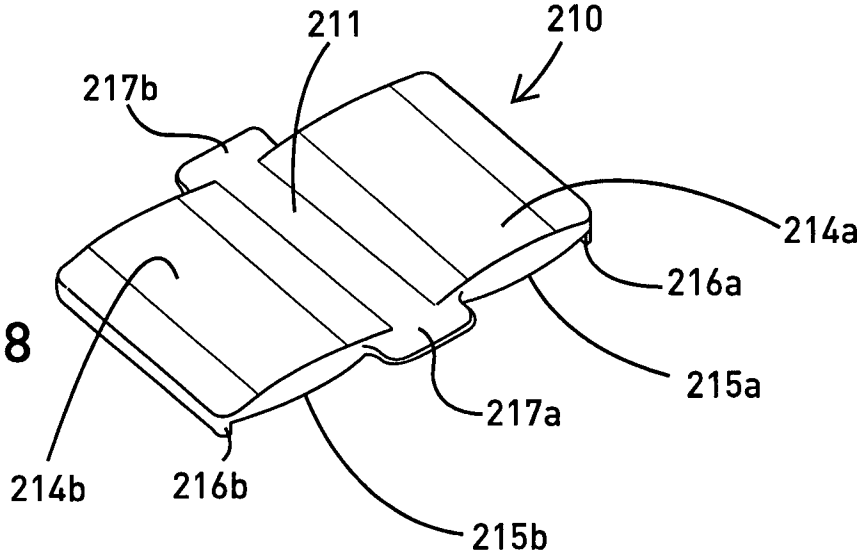
FIG. 8 is a perspective view of the third embodiment of the pad shown in FIG. 7.

Referring to FIGS. 7-8, a third preferred embodiment of a pad 210 constructed according to the invention is illustrated. Referring to the side elevation view of FIG. 7, the pad 210 is shown having a main body 211 that is preferably substantially flat with a first pair of bulges 214*a*, 214*b* protruding upward from the main body 211, and a second pair of bulges 215*a*, 215*b* protruding downward from the main body 211. The pad 210 in this alternate embodiment has centering wings 217*a*, 217*b* as well as locking lips 216*a*, 216*b* to hold the pad 210 in the center of a clip-on wear plate.

Preferably, the pads 10, 110, 210 are constructed from a suitable elastomeric material that is durable and resilient. Preferred materials from which the pads 10, 110, 210 may be made include natural and synthetic rubbers, polyurethanes, urethanes, elastomers, co-elastomers, thermoplastic elastomers (TPE), copolyester elastomers (COPE) and other suitable materials. Preferably, the durometer of the pad is from about 58 A to 75 D, and more preferably from about 70 A to 75 D, or from about 90 A to 58 D. Although the pads 10, 110, 210 shown and described herein preferably may be constructed having a thickness suitable to handle the force loads that are anticipated being received from the truck and associated rail cars and the car loads, it has been found that preferred pad thicknesses may range from between about 1/32" and 4/7". The pads shown and described herein may be constructed from a one-piece component, or alternately, the pads may be constructed from one or more components. For example, in some instances it may be advantageous to utilize a two-part pad, where, for example, the locking lips 16*a*, 16*b*, 116*a*, 116*b*, 216*a*, 216*b*, and centering arms, 17*a*, 17*b*, 217*a*, 217*b* are made from lower cost tougher plastic or metal. The pad 10, 110, 210 may be constructed by molding, casting, extruding, or other suitable production technique.

Figure 10:
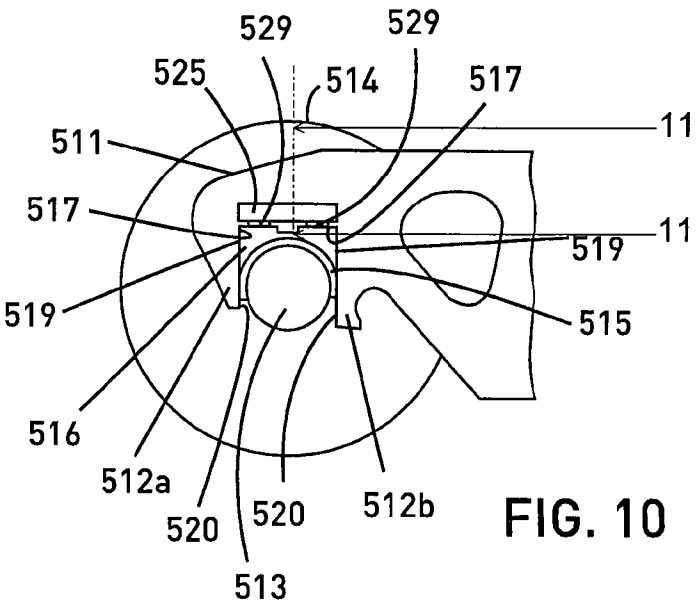
FIG. 10 is a side elevation view of the side frame and axle assembly of FIG. 9, shown with the components, including the pad of FIG. 1, installed in an assembled condition.
Figure 9:
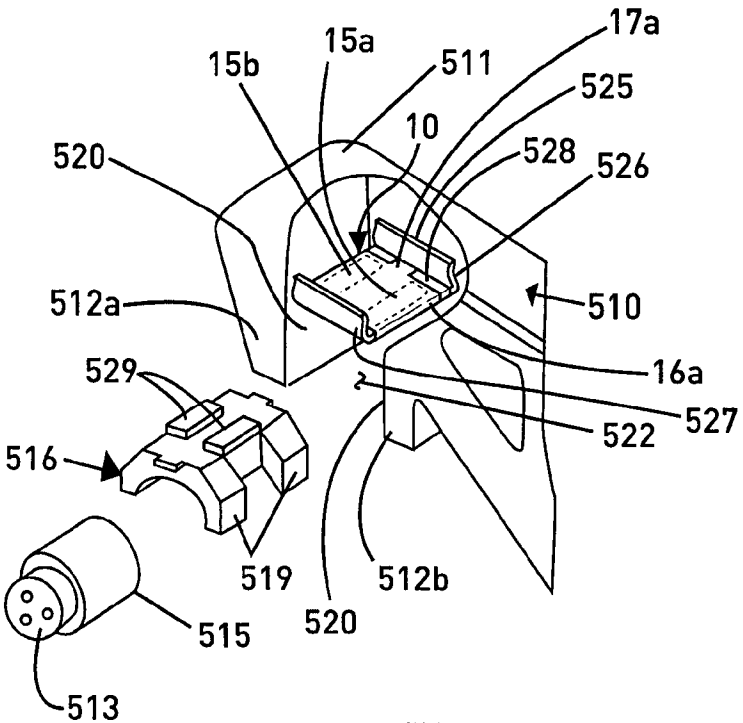
FIG. 9 is an exploded view of an example of a side frame and axle of a railway truck, with a portion of the frame being shown in a cut away view to expose the wear plate.
Figure 11:
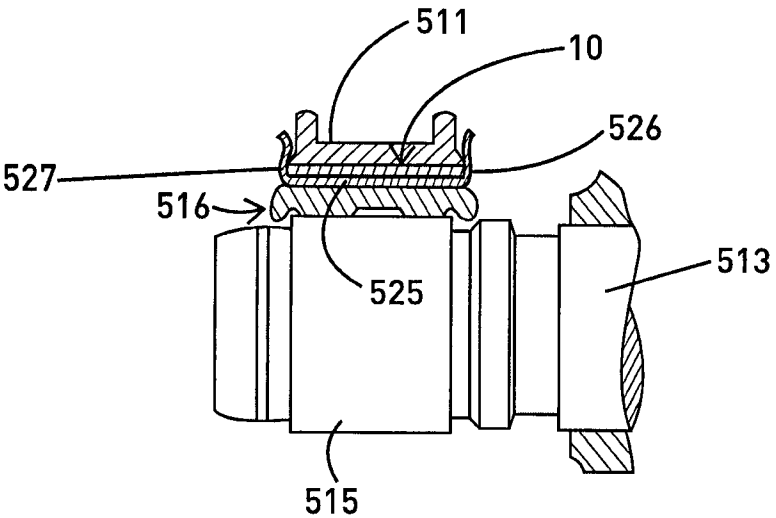
FIG. 11 is a sectional view of the frame and axle assembly of FIG. 10, with the bearing adapter, wear plate, pad and pedestal shown in a sectional view taken through the line 11-11 of FIG. 10.

The present invention thereby offers a practical and effective solution to the serious tensile stress related plate bending and breaking problems experienced by clip-on pedestal wear plates. An exemplary environment is illustrated in FIGS. 9-11, where a fragmentary portion of a pedestal 511 and frame 510 of a rail car truck is shown. The frame 510, although shown in part is generally part of a railway truck, which are commercially known in the industry to include a pair of spaced apart side frames supported on wheel and axle assemblies, with a bolster connected between the side frames for supporting the rail car body. FIG. 9 illustrates one end of a side frame 510 terminating in the pedestal 511 in the form of a downwardly open pedestal jaw 512*a*, 512*b* engaged over the axle 513 on which the car wheels 514 (FIG. 10) are mounted. As shown in FIGS. 9-11, a roller bearing 515 is carried on the axle 513 near the end thereof, and a bearing adapter 516 is provided between the top portion of the bearing 515 and the internal surfaces 517 of the pedestal 511. The downwardly facing surface 518 of the adapter 516 is curved to correspond to the cylindrical outer race of the bearing 515, and the upper portion of the adapter comprises a top slightly convex surface which normally bears against a downwardly facing flat surface 517 in the pedestal opening. A pedestal wear plate 525, or wear liner as it is sometimes referred to, is shown between the pedestal roof and the bearing 516. In the illustration, the pedestal wear plate 525 is a clip-on pedestal wear plate 525 having upward side lips 526, 527 that clamp the plate 525 on the pedestal 511. Side surfaces 519 are provided on the adapter 516 in engagement with corresponding surfaces 520 in the pedestal opening 522. Thus, the upper portion of the adapter 516 is generally rectangular so as to be received in the rectangular pedestal opening 522 or roof, although the adapter corners are omitted or cut away to prevent galling of the corners in the pedestal opening. Although only a single side of the rail car truck pedestal is shown in partial view, preferably, similar to the left side shown, there is a pedestal at the right side of the side frame that is similar to the pedestal shown. According to a preferred installation configuration, the pads 10, 110, 210 shown and described herein are designed to be placed on the pedestal facing surface 528 of the wear plate 525. The pad 10 is shown installed on the wear plate 525. In the example illustrated, the adapter 516 includes a pair of raised surfaces 529, and the raised portions 15*a*, 15*b* are provided over the raised surfaces 529.

Figure 12:
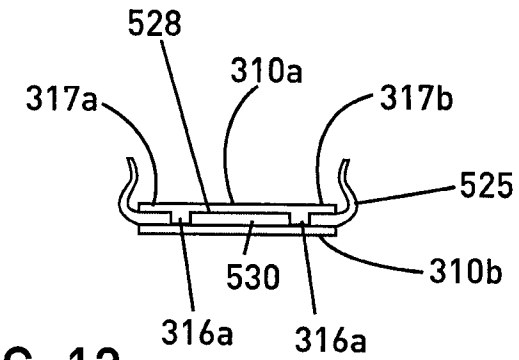
FIG. 12 is a right side elevation view showing an alternate installation of a pad according to the invention shown in use with a wear plate, where a first pad is provided on one side of the wear plate and a second pad is provided on the other side of the wear plate.

Referring to FIG. 12, an alternate embodiment of a pad configuration 310 for a wear plate is shown in an alternate installation configuration. The pad installation is illustrated including a first pad 310*a*, that may comprise a pad such as those pads 10, 110, 210, shown and described herein, and a second pad 310*b* that also may comprise a pad, such as those pads 10, 110, 210, shown and described herein. In the embodiment illustrated in FIG. 12, the first pad 310*a* is shown configured like the pad 10, and has locking lip segments 316*a* (only one being shown) and tab portions 317*a*, 317*b*. The second pad 310*b*, which preferably may be a second one of any of those pads 10, 110 and 210 shown and described herein, is shown in FIG. 12, according to a preferred embodiment, having a configuration like the pad 110. The dimensions of the lower pad 310*b* may be provided to correspond with an adapter with which the pad 310*b* is used, such as the adapter 516 (shown in FIGS. 9-11), and may provide locking lips not shown (that are similar to those 316 of the upper pad 310*a*). The pads 310*a*, 310*b*, according to preferred embodiments, may be constructed from material that is the same as that described herein in connection with the pads 10, 110, and 210. The first pad 310*a*, when installed in a pedestal 511 with a wear plate 525, engages the upper surface 528 of the wear plate 525 and engages the downwardly facing pedestal surface, such as, for example, the flat surface 517 in the pedestal opening (see e.g., FIGS. 9-11 where a pedestal 511 is illustrated). The second pad 310*b* is designed for disposition between the wear plate lower surface 530 and the upper surface of a bearing adapter, such as, for example, the adapter 516 illustrated in FIGS. 9-11.

Figure 13:
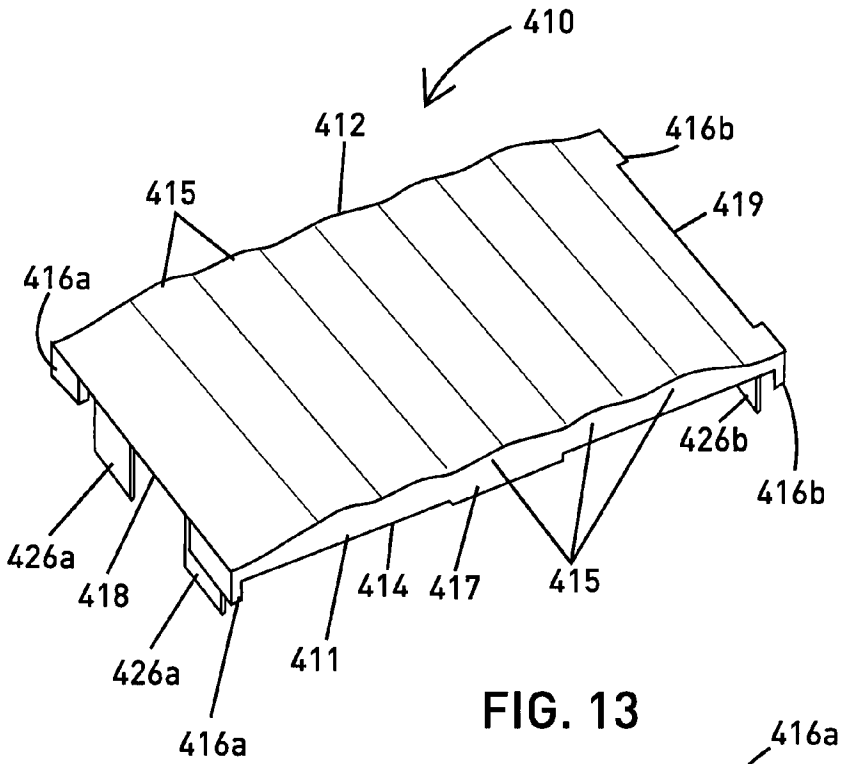
FIG. 13 is a perspective view of a fourth embodiment of a pad according to the invention.
Figure 14:
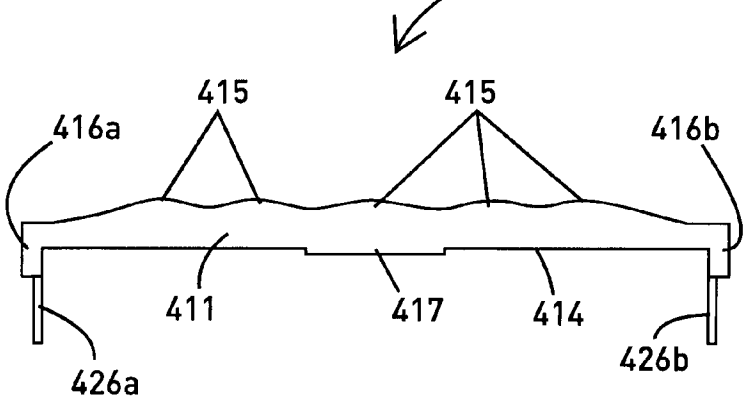
FIG. 14 is a right side elevation view of the fourth embodiment of the pad shown in FIG. 13.

According to an alternate configuration, the second pad 310*b* is provided and installed between the wear plate 525 and the adapter 516, and the wear plate upper surface 528 is permitted to carry the pedestal 511 directly thereon. According to another alternate installation configuration, a pad, such as those pads 10, 110, and 210 shown and described herein, is positioned between the bearing adapter 516 and the downwardly facing flat surface 517 in the pedestal opening so that the flat surface 517 engages a surface on one side of the pad and the upper portion of the bearing adapter 516 engages the surface on the other side of the pad. The pad 10, 110, 210 facilitates the force handling by handling force loads received through the pedestal 511. In FIGS. 13 and 14, an alternate embodiment of a pad 410 is illustrated having a preferred configuration for placement between a bearing adapter 516 and the downwardly facing flat surface 517 of the pedestal 511 (as illustrated in connection with the pad 310 in FIGS. 9-11). The pad 41.0 preferably is configured for disposition on a bearing adapter, such as, for example the bearing adapter 516 shown in FIGS. 9-11. The pad 410 has an upper surface 412 and a lower surface 414. The upper surface 412 preferably has force handling means for handling force loads. According to a preferred construction, a plurality of force handling means is illustrated comprising raised portions 415 of the upper surface 412. The raised portions 415 preferably are bulged and are disposed transversely on the pad 410 in a spaced apart relation to each other. According to a preferred embodiment, the pad 410 preferably is configured with a lower surface 414 having one or more corresponding surface features that preferably align with a bearing adapter, such as, for example, the bearing adapter 516 illustrated herein. An alignment feature is illustrated comprising a centering tab 417 that is transversely disposed relative to the length of the pad 410. The pad 410 includes a first end 418 and a second end 419. Locking lips 416*a*, 416*b* are provided at the ends of the pad 410. A second set of lips, the second lips 426*a*, 426*b*, are provided on the pad 410. According to a preferred construction, the second lips 426*a*, 426*b* protrude downwardly from the pad body 411 and are disposed relatively inward from the first lips 416*a*, 416*b* in relation to the length of the pad 410 and the pad ends 418, 419. Although a plurality of raised portions 415 are illustrated, the pad 410 may be constructed with a number of raised portions greater or lesser than those shown in FIGS. 13 and 14. The pad 410 may be utilized in an installation where the pedestal roof or upper surface 517 engages with the upper surface 412 of the pad 410. The lower surface 414 may engage the upper surface of a bearing adapter 516. According to a preferred embodiment, the central portion 417 may be constructed for disposition on the bearing adapter, such as, for example, the installation between the raised surface portions 529 of the bearing adapter 516 illustrated in FIGS. 9-11. Although the central portion 417 and the first locking lips 416*a*, 416*b* and second lips 417*a*, 417*b* are illustrated in a preferred arrangement, the first and/or second lips may be provided having different configurations and numbers that aid in aligning and positioning the pad 410 relative to a bearing adapter and/or pedestal.

Figure 15:
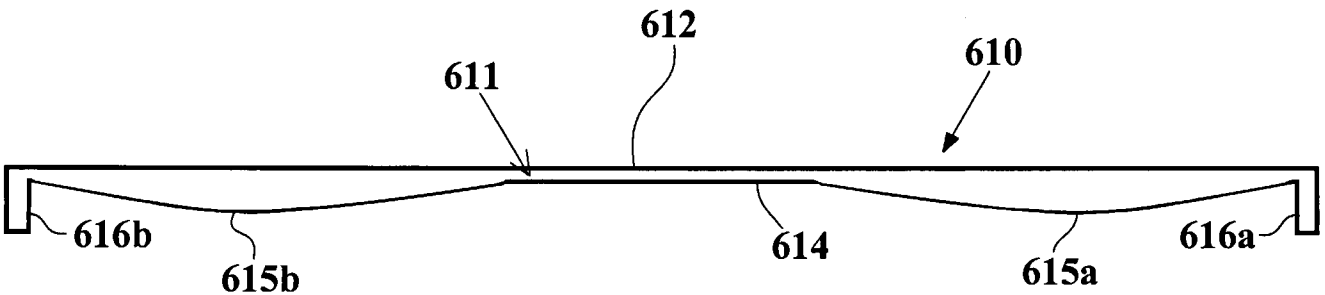
FIG. 15 is a right side elevation view of a fifth embodiment of a pad according to the invention.

FIG. 15 shows an alternate embodiment of a pad 610 having a main body 611 with an upper surface 612 and lower surface 614, where the upper surface 12 is configured as a substantially planar surface, and where the lower surface 614 is provided having force handling means comprising a force handling configuration similar to those shown and described herein, such as, for example, raised portions 615*a*, 615*b* (similar to those raised portions 15*a*, 15*b* shown in FIG. 2). The raised portions 615*a*, 615*b* preferably are bulged and are disposed transversely on the pad 610 in a spaced apart relation to each other. The pad 610 may be constructed similar to the pad 10 shown and described in connection with FIGS. 1-3. The pad 610 may be used in installations similar to those pads shown and described herein, including, for example, on top of the pedestal wear plate 525, or below the pedestal wear plate 525, or with another pad (as in FIG. 11) that is placed above or below the pedestal wear plate 525; or without a pedestal wear plate, where the pad is placed on the top of the adapter 516.

While preferred embodiments and example configurations have been shown and described, it is to be understood that various further modifications and additional configurations will be apparent to those skilled in the art. Other embodiments of the invention, for example, may comprise more or fewer bulges on the top face and/or bottom face. Although locking lips 16, 116 and 216 are illustrated along the edge of the pad 19, 110, 210, respectively, the locking lips may be configured as one or more segments or elements, such as, for example, the locking segments 316 shown in FIG. 12. Further, although the locking lips and extended portions are illustrated in preferred embodiments having preferred arrangements, different configurations and numbers of locking lips and/or extended portions may be provided. In addition, the pads shown and described herein may be made having a dimension suitable for the size of the pedestal, adapter and/or other components that the pad is to be used with. According to some embodiments; the pad may have a thickness ranging from about 1/32" to 4/7", and more preferably, according to some embodiments, from about 1/16" to 1/3". It is intended that the specific embodiments and configurations disclosed are illustrative of the preferred and best modes for practicing the invention, and should not be interpreted as limitations on the scope of the invention as defined by the appended claims.

What is claimed is:

1. A system for a railway truck bearing adapter assembly including:

a bearing adapter, and a non-metallic pad and clip-on pedestal wear plate for installation between a downwardly facing flat surface in a pedestal opening of a side frame of a railway truck, the non-metallic pad being configured for engagement with said clip-on pedestal wear plate and the pedestal roof, the truck having lateral side walls, the pedestal opening having a downwardly facing surface, wherein said clip-on pedestal wear plate includes means for connecting said wear plate to said truck lateral side walls;

wherein said non-metallic pad has bulges disposed thereon, wherein said non-metallic pad is disposed between the wear plate and the downwardly facing flat surface of said pedestal opening of the side frame of said railway truck pedestal, and wherein said bearing adapter is disposed below said wear plate and supports said wear plate.

2. The system of claim 1, wherein said non-metallic pad has a first surface that contacts the flat surface of said pedestal opening and wherein said non-metallic pad has a second surface that contacts said clip-on pedestal wear plate.

3. The system of claim 1, wherein said clip-on wear plate has a pair of upstanding side walls.

4. The system of claim 3 wherein said non-metallic pad includes a pair of arms outwardly disposed from a longitudinal side of said body, and wherein said arms are disposed between said upstanding side walls.

5. In a railway vehicle truck bearing adapter assembly, including a bearing adapter and a clip-on pedestal wear plate having resilient arms for clipping on to the side of a pedestal of the railway truck, wherein the improvement comprises a non-metallic pad for disposition between a railway truck pedestal of a rail vehicle and the clip on wear plate, the pad comprising:

a body having a first surface and a second surface;

wherein at least one of said first surface and said second surface has a plurality of raised portions, wherein the pad has a longitudinal dimension defining a length of the pad, wherein said raised portions are transversely disposed in relation to said longitudinal dimension, and wherein said pad has a thickness that is substantially uniform in height across its transverse cross-sectional width.

6. The invention defined in claim 5 where said non-metallic pad is cast, molded or extruded from a material having a hardness in the range of 70 A to 75 D durometer.

7. The invention defined in claim 5 where said non-metallic pad is cast, molded or extruded from a material having a hardness in the range of 90 A to 58 D durometer.

8. The invention defined in claim 5 where said non-metallic pad is preferably cast, molded or extruded from an elastomeric material.

9. The invention defined in claim 5 where aid non-metallic pad is cast, molded or extruded from an elastomeric material such as polyurethane, rubber or TPE.

10. The invention defined in claim 5 where said non-metallic pad is preferably in the thickness range of 1/32" to 4/7".

11. The invention defined in claim 5 where said non-metallic pad is in the thickness range of 1/16" to 1/3".

12. The invention defined in claim 5 wherein at least one of said non-metallic pad first surface and said non-metallic pad second surface is a flat surface and wherein at least the other of said first surface and said non-metallic pad second surface has two bulges.

13. The invention defined in claim 12, wherein said bearing adapter has raised surfaces, where said two bulges run perpendicular to the pad length and are positioned to align with said bearing adapter raised surfaces.

14. The invention defined in claim 5 where said non-metallic pad has a contact surface area smaller than the clip-on pedestal wear plate.

15. The invention defined in claim 5 where said non-metallic pad has a contact surface of similar size to the adapter.

16. The invention of claim 5, including holding means for holding the pad in alignment at a location on a pedestal wear plate.

17. The invention of claim 16, wherein said holding means comprises a lip disposed at each longitudinal end of said pad.

18. The invention of claim 17, wherein said lip is transversely disposed in relation to said longitudinal pad dimension.

19. The invention of claim 5, wherein said first surface comprises a substantially flat surface and wherein said second surface has a plurality of raised portions.

20. The invention of claim 5, wherein said first surface has a plurality of raised portions and wherein said second surface has a plurality of raised portions.

21. The invention of claim 20 wherein said raised portions comprises bulges, and wherein said bulges of said first surface are provided in locations above the bulges in said second surface.

22. The invention of claim 21, including a lip disposed at each longitudinal end of said pad.

23. The invention of claim 19, wherein said raised portions comprise bulges.

24. The invention of claim 19, wherein said pad includes a pair of arms outwardly disposed from a longitudinal side of said body.

25. The invention of claim 19, wherein said arms are disposed at locations along the longitudinal edge of the pad between said plurality of raised portions.

26. The invention of claim 5, including a wear plate having a first surface and a second surface, wherein said pad is disposed on said wear plate first surface.

27. The invention of claim 26, including a second pad, a bearing adapter and a pedestal, wherein said second pad is disposed on said wear plate second surface, said second pad engaging said bearing adapter and said wear plate second surface, and said first pad engaging said wear plate upper surface and said pedestal.

28. The invention of claim 5, including holding means for holding the pad in alignment in relation to a pedestal.

29. The invention of claim 28, wherein said holding means comprises a first lip disposed at each longitudinal end of said pad, and a second lip disposed at each longitudinal end of said pad and being located longitudinally inward of said first lip.

30. The invention of claim 5, wherein said pad is constructed having alignment means for aligning said pad on the surface of a bearing adapter.

31. The invention of claim 30, wherein at least one of said first surface and said second surface has a plurality of raised portions, and wherein alignment means is provided on the other of said first surface and said second surface, and wherein said alignment means comprises a central portion that is a raised portion.

32. A non-metallic pad for a railway truck pedestal of a rail vehicle, the pad comprising:

a body having a first surface and a second surface;

holding means for holding the pad in alignment in relation to a pedestal;

wherein at least one of said first surface and said second surface has a plurality of raised portions, wherein the pad has a longitudinal dimension defining a length of the pad, wherein said raised portions are transversely disposed in relation to said longitudinal dimension; and wherein said holding means comprises a first lip disposed at each longitudinal end of said pad, and a second lip disposed at each longitudinal end of said pad and being located longitudinally inward of said first lip.

33. A non-metallic pad for a railway truck pedestal of a rail vehicle, the pad comprising:

a body having a first surface and a second surface;

wherein at least one of said first surface and said second surface has a plurality of raised portions, wherein the pad has a longitudinal dimension defining a length of the pad, wherein said raised portions are transversely disposed in relation to said longitudinal dimension;

wherein said pad is constructed having alignment means for aligning said pad on the surface of a bearing adapter; and wherein at least one of said first surface and said second surface has a plurality of raised portions, and wherein alignment means is provided on the other of said first surface and said second surface, and wherein said alignment means comprises a central portion that is a raised portion.

* * * * *